US005420931A

United States Patent [19]

Donner

[11] Patent Number: 5,420,931

[45] Date of Patent: May 30, 1995

[54] LOW AND HIGH QUALITY ENTERTAINMENT SYSTEM FOR PLAYING LOW AND HIGH QUALITY COMMUNICATION MEDIA FOR AN AUTOMOBILE

[75] Inventor: Irah H. Donner, Silver Spring, Md.

[73] Assignee: Donner, Inc., Silver Spring, Md.

[21] Appl. No.: 104,446

[22] Filed: Aug. 10, 1993

[51] Int. Cl.[6] ..... H04R 25/00

[52] U.S. Cl. ..... 381/86; 381/81; 381/18

[58] Field of Search ..... 381/86, 153, 103, 18, 381/81; 455/345

[56] References Cited

U.S. PATENT DOCUMENTS

| | | | |
|---|---|---|---|
| 4,691,361 | 9/1987 | Yoshino et al. | 381/81 |
| 5,034,996 | 7/1991 | Carey et al. | 381/86 |
| 5,146,507 | 9/1992 | Satoh et al. | 381/103 |

*Primary Examiner*—Curtis Kuntz
*Assistant Examiner*—Sinh Tran

[57] ABSTRACT

An entertainment system for a vehicle having front and rear speakers includes a high quality entertainment system for playing a high quality medium to first passengers of the vehicle desiring high quality entertainment by outputting a high quality signal, and a low quality entertainment system for playing a low quality medium to second passengers of the vehicle by outputting a low quality signal, the second passengers having no preference between the high quality entertainment and low quality entertainment. In addition, the entertainment system includes a controller monitoring the high and low quality signals output from the high and low quality entertainment systems respectively, and outputting a control signal to control switching between the high and low quality entertainment systems and the front and rear speakers responsive to the high and low quality signals. Further, a switch is provided, connected to the low and high quality entertainment systems and the controller, where the switch connects the low and high quality entertainment systems responsive to the control signal received from the controller.

20 Claims, 5 Drawing Sheets

LOW AND HIGH QUALITY ENTERTAINMENT SYSTEM FOR PLAYING LOW AND HIGH QUALITY COMMUNICATION MEDIA FOR AN AUTOMOBILE

BACKGROUND OF THE INVENTION

1. Field of the Invention

The present invention relates to the field of entertainment systems such as audio and video systems for automobiles, and in particular, to the field of audio and video systems where, for example, two audio or two video systems are installed in an automobile. The first audio or video system is designed for the playing requirements of passengers who occupy the front seats of the automobile, particularly the driver. The second audio or video system is designed for the playing requirements of passengers occupying the rear seats of the automobile.

2. Description of the Related Art

Presently, entertainment systems in automobiles, such as audio or video systems, are usually restricted to a single type of system in an automobile, for example, a single cassette player, a single compact disk (CD) player, etc. which typically share the identical speaker system for outputting sounds such as music. In instances where separate speaker systems are provided for the different types of entertainment systems in the automobile, the entertainment system including the separate speaker system is typically an "add on" system. One example of an "add on" system may be a television containing its own speakers which when plugged into a cigarette lighter may be used in the automobile.

However, presently, the current entertainment systems in the automobile are not designed to accommodate the playing requirements of the various listeners in the automobile. Specifically, one of the situations which the present entertainment systems in automobiles are unable to manage is the situation where a first set of listeners are accustomed to viewing or listening to a high quality entertainment medium using a high quality entertainment system, while the second group of listeners are accustomed to viewing or listening to a low-quality entertainment medium on either high or low quality entertainment system. These second group of people represent the unsophisticated user having "untrained" ears. The term "entertainment medium" or "medium" are defined to mean any type of magnetic tape for video/audio play, any type of compact disc for video/audio play or any other type of communication medium which is frequently used for entertainment systems in automobiles.

Typically, the present automobiles will offer only a high quality entertainment system and force the second group of users to view or listen to the low quality entertainment medium using the high quality entertainment system. This creates a problem in that the high quality entertainment system may be damaged due to the low quality medium played on the high quality system. In addition, the low quality medium is typically characterized by constant non-stop playing which increases the low quality of the medium.

To put the above situation in concrete terms by way of an example, it is not desirable to have to play children's music which is typically recorded on a low quality tape and played over and over again on a high quality tape system for which an adult may wish to hear high quality music such as an opera, symphony or rock and roll. The poor quality children's tape soils the high quality tape and may ruin it. If the high quality cassette is ruined, it will cost much money to repair or replace. In contrast, if the children's cassette is played on a low quality cassette, it will likely be less expensive to simply replace the low quality cassette than to attempt to repair it. Thus, the consumer enjoys great savings, and what is even sweeter is that the children will never know the difference due to their untrained ears!

Thus, it is desirable that an entertainment system be provided in an automobile which permits high quality medium to be played on a high quality entertainment system while also permitting low quality medium to be played on a low quality entertainment system. The high quality system may be a system as provided by an automobile manufacturer such as a Nissan factory installed cassette system or a stereo cassette system such as that manufactured by Sherwood TM Model CRD-230 having a retail price of approximately $300. In fact, typical high quality entertainment systems will cost a consumer, for example, anywhere from $100–$150 and up, i.e, systems whose repair price is likely to be less expensive than its replacement cost. In contrast, low quality systems may be purchased from stores such as Radio Shack TM or Kmart TM which may cost the consumer only $30. For example, Ames Department Stores sell Roadmaster cassette systems and accessories from $16 to 60$. These low quality systems are typically less expensive to replace than to repair due to today's inflated costs of labor.

Thus, it is desirable to avoid the necessity of paying the high cost of labor for repairing entertainment systems when the user does not require a high quality system and when it is possible to replace the system for less money.

In addition, it is desirable to minimize the cost of owning the high and low quality entertainment systems in the automobile by having the systems share the same speaker system, either in part or in its entirety.

It is also desirable that, in certain situations, that the high and low quality entertainment systems play in separate predesignated locations in the automobile where the output of the high and low quality entertainment systems is expected.

In addition, it is also desirable that, in certain situations, that the high and low quality entertainment systems play in separate predesignated locations in the automobile simultaneously where the output of the high and low quality entertainment systems is expected.

Further, it is desirable that in certain circumstances the high and low quality entertainment systems play the same medium to the different occupants in the automobile.

SUMMARY OF THE INVENTION

It is an object of the present invention to provide a system in an automobile which permits high quality medium to be played on a high quality entertainment system while also permitting low quality medium to be played on a low quality entertainment system.

It is another object of the present invention to avoid the necessity of paying the high cost of labor for repairing entertainment systems when the user does not require a high quality system and when it is possible to replace the system for less money.

It is another object of the present invention to provide an entertainment system having high and low quality entertainment systems which minimize the amount of speakers installed in the automobile.

Another object of the present invention is, in certain situations, to arrange that the high and low quality entertainment systems play in separate predesignated locations in the automobile, separately or simultaneously, where the output of the high and low quality entertainment systems is expected.

It is another object of the present invention that in certain circumstances the high and low quality entertainment systems play the same medium to the different occupants in the automobile.

Further, it is another object of the present invention that at least the low quality entertainment system is modularly connected to a dashboard of an automobile and to the speakers in the automobile to facilitate convenient discarding of the low quality entertainment system in the event technical problems are experienced.

To achieve these and other objects, the present invention provides an entertainment system for a vehicle having front and rear speakers. The entertainment system includes a high quality entertainment system for playing a high quality medium to first passengers of the vehicle desiring high quality entertainment by outputting a high quality signal, and a low quality entertainment system for playing a low quality medium to second passengers of the vehicle by outputting a low quality signal, the second passengers having no preference between the high quality entertainment and low quality entertainment. In addition, the entertainment system includes a controller monitoring the high and low quality signals output from the high and low quality entertainment systems respectively, and outputting a control signal to control switching between the high and low quality entertainment systems and the front and rear speakers responsive to the high and low quality signals. Further, a switch is provided, connected to the low and high quality entertainment systems and the controller, where the switch connects the low and high quality entertainment systems responsive to the control signal received from the controller.

These together with other objects and advantages which will be subsequently apparent, reside in the details of construction and operation as more fully hereinafter described and claimed, with reference being had to the accompanying drawings forming a part hereof, wherein like numerals refer to like elements throughout.

DETAILED DESCRIPTION OF THE PREFERRED EMBODIMENTS

Figure 1:
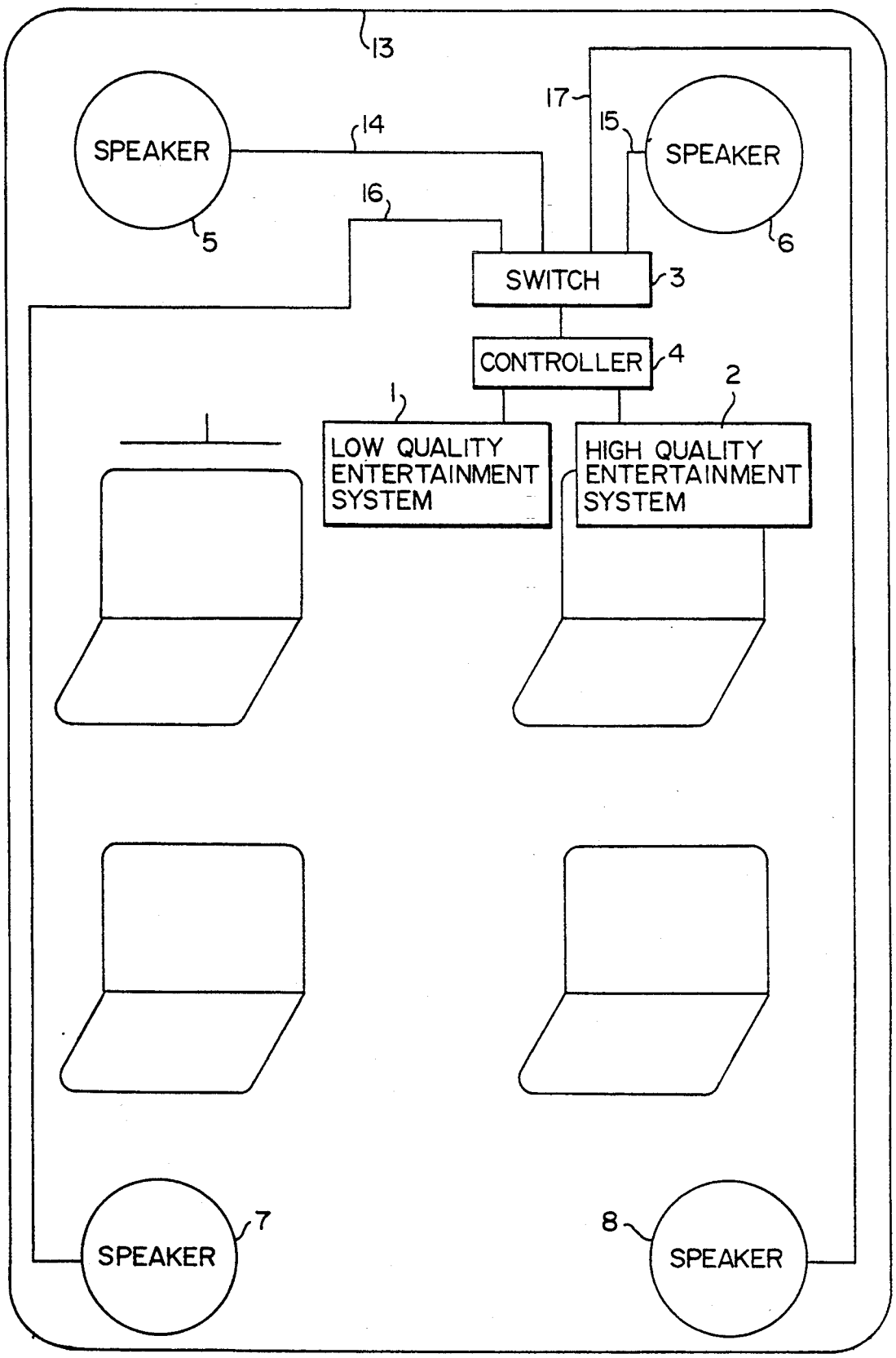
FIG. 1 is a conceptual drawing of the entertainment system of the present invention in an automobile.

FIG. 1 is a conceptual drawing of the entertainment system of the present invention arranged in an automobile. In FIG. 1, four speakers 5–8 are typically provided in automobile 13; for example, two speakers 5–6 for the passengers in the front seat and two speakers 7–8 for the passengers in the rear seat. In the present invention, each of speakers 5–8 are connected to switch 3 via conductors 14–17. Switch 3 is also connected to low and high quality entertainment systems 1 and 2 to connect the appropriate entertainment system to the appropriate speakers as required. As indicated earlier, low and high quality entertainment systems 1 and 2 represent a low quality entertainment system for playing low quality medium, and a high quality entertainment system for playing high quality medium, respectively.

Accordingly, since the passengers listening to the low quality entertainment system have untrained ears, it is unnecessary to risk damage to the high quality entertainment system for playing the low quality medium. Thus, switch 3 connects high quality entertainment system 2 to the appropriate speakers, which may be predetermined to be, for example, all four speakers 5–8 when only high quality entertainment system 2 is active, and the front speakers 5–6 when both low and high quality entertainment systems 1–2 are active. Conventional controller 4 is connected to switch 3 to control the above appropriate switching based upon the received signals from low and high quality entertainment systems 1 and 2. Thus, controller 4 monitors the signals output from low and high quality entertainment systems 1–2 and controls switch 3 in response to the monitored signals in a conventional manner. Controller 4 may be, for example, a microprocessor which has the requires switching instructions, discussed below, in microcode. In addition, Controller 4 may monitor the signals output from the low and high entertainment systems 1–2 for the existence of the signals to determine that active status of each of the low and high quality entertainment systems 1–2, or alternatively, controller 4 may monitor the signal characteristics as well. Since low quality entertainment systems will likely suffer from a greater signal distortion than high quality entertainment systems, controller 4 may, optionally, determine based upon the received signal characteristics, which of the low and high quality entertainment systems 1–2 have output the signal and is active.

A typical switching scheme, although others will be apparent, is as follow: When only one passenger in the automobile is present, the passenger is the driver who will likely desire to experience high quality entertainment system 2. Thus, when only high quality entertainment system 2 is being used, switch 3 is controlled by controller 4 to operate high quality entertainment system 2 using all four speakers 5–8 since high quality music is likely, at times, to be quadraphonic requiring the use of all four speakers 5–8.

Alternatively, controller 4 is designed to control switch 3 so that when only the low quality entertainment system 1 is activated, only rear speakers 7–8 are connected to the low quality entertainment system 1. In this scenario, the assumption is that the intended listener or viewer is one who is not sophisticated, and therefore, likely to listen to low quality medium not being able to appreciate the difference between the high and low quality medium. In fact, it is likely that the unsophisticated listener or viewer will not even have the option for purchasing the desired entertainment medium on high quality medium. For example, children's music is often recorded on low quality cassettes which may damage more sensitive high quality cassette players. In addition, it may be too expensive or unnecessary to purchase the high quality medium for the unsophisticated person with untrained ears since this would simply be a waste of money.

The present invention is also designed to play the appropriate medium to both sophisticated and non-sophisticated listeners or viewers simultaneously. For example, when both the sophisticated and non-sophisticated listeners or viewers wish to listen or view the medium simultaneously, controller 4 controls switch 3 to connect high quality entertainment system 2 to, for example, front speakers 5–6, and to connect low quality entertainment system 1 to speakers 7–8 when both low and high quality entertainment systems 1–2 have been determined to be active by controller 4. This scenario, for example, would allow the driver of children to listen to their own music on high quality entertainment system 2 while the children could listen to their own music which is typically of a poor quality having been played over and over again on low quality entertainment system 1.

Controller 4 is further able to control switch 3 to connect the appropriate speakers to low and high quality entertainment systems 1–2 depending on whether one or both of low and high quality entertainment systems 1–2 are active. Thus, if, for instance, controller 4 detects that only high quality entertainment system 2 is active, and then controller 4 subsequently determines that low quality entertainment system 1 is also to be activated by the user, controller 4 changes the connection of speakers from speakers 5–8, all being connected to high quality entertainment system 2, to speakers 5–6 being connected to high quality entertainment system. 2 and speakers 7–8 being connected to low quality entertainment system 1. This above example assumes that the sophisticated listener or viewer is seated in the front seats of the automobile, and the unsophisticated listener or viewer is seated in the rear seats of the automobile. Of course, other scenarios or connections of speakers to the low and high quality entertainment systems 1–2 may be available and are within the scope of the present invention.

It should also be noted that in the alternative to an electronically controlled switch, switch 3 may also be a toggle switch, for example, a three-position toggle switch which performs the switching operations indicated above. According to this scheme, controller 4 is replaced by a person who manually determines which combination of speakers and entertainment systems to experience based upon the setting of the toggle switch.

Figure 2:
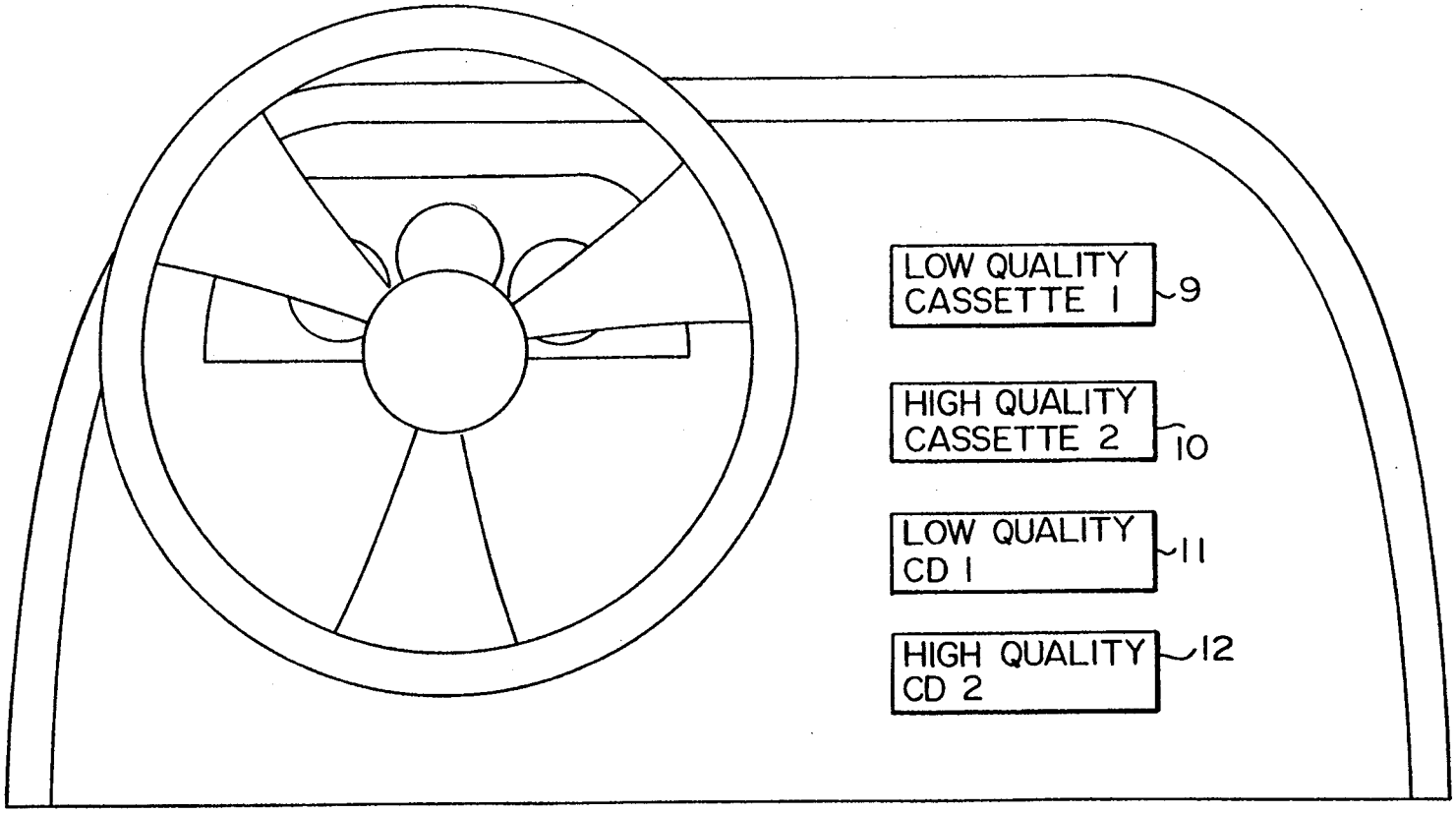
FIG. 2 is a diagram of the present invention as installed in the dashboard of an automobile.

FIG. 2 is a diagram of one example of the present invention as installed in the dashboard of an automobile. As shown in FIG. 2, the dashboard of the automobile includes various entertainment systems installed therein. In this example, four entertainment systems are installed in the dashboard. Specifically, low and high quality cassettes 9 and 10 are installed in the dashboard. In addition, low and high quality compact discs 11 and 12 are also installed in the dashboard.

According to the above arrangement, controller 4 controls switch 3 to connect the various entertainment systems 9–12 as previously described where controller 4 is able to determine the whether cassettes 9 and 10 and compact discs 11 and 12 are activated. In addition, controller 4 is preset to identify that cassette 10 and compact disc 12 represent high quality systems and cassette 9 and compact disc 11 may represent low quality entertainment systems. Thus, controller 4 is able to determine which of speakers 5–8 should be connected to the appropriate low and high quality entertainment systems 9–12.

Figure 3:
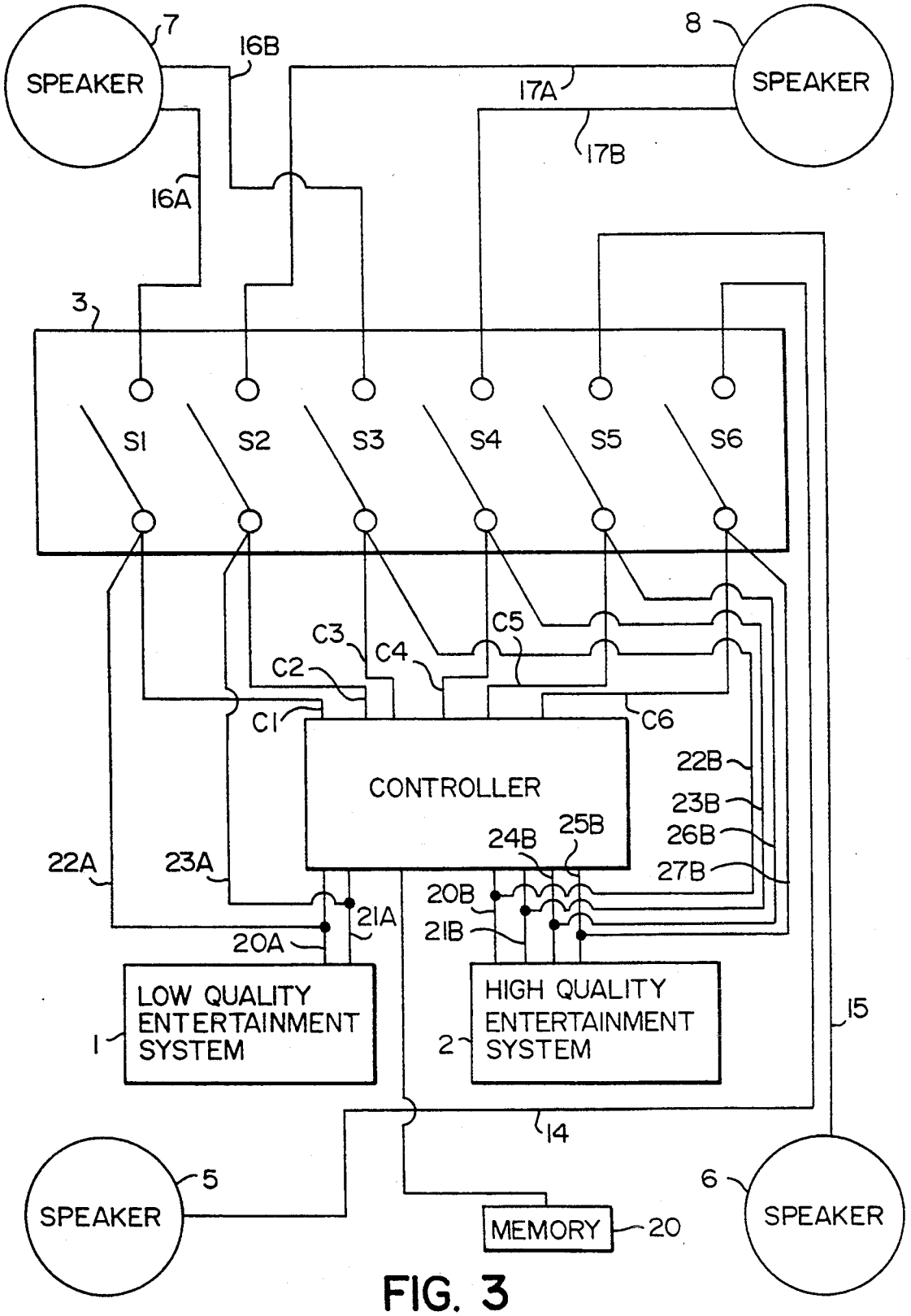
FIG. 3 is a detailed circuit diagram of a first embodiment of the entertainment system of the present invention.

FIG. 3 is a detailed circuit diagram of a first embodiment of the entertainment system of the present invention defining the connections between switch 3, controller 4 and speakers 5–8. In FIG. 3, switch 3 includes six separate switches S1–S6 which are controlled by controller 4. Speakers 5 and 6 are connected to switches S5 and S6 via conductors 14 and 15 for broadcasting sound to the front of the automobile played by high quality entertainment system. In addition, speaker 7 is connected to switches S1 and S3 via conductors 16A and 16B, and speaker 8 is connected to switches S2 and S4 via conductors 17A and 17B.

In addition, controller 4 monitors the signals output from low and high quality entertainment systems 1–2. As shown in FIG. 3, controller 3 monitors signals output from low quality entertainment system 1 via conductors 20A and 21A and monitors signals output from high quality entertainment system 2 via conductors 20B, 21B, 24B and 25B.

Further, the low and high quality entertainment systems 1–2 are connected to switches S1–S6 for switching to the appropriate speakers 5–8. Specifically, low quality entertainment system 1 is connected to switches S1 and S2 via conductors 22A and 23A, and high quality entertainment system 2 is connected to switches S3–S6 via conductors 22B, 23B, 26B and 27B. Finally, controller 4 is connected to switches S1–S6 via conductors C1–C6 for controlling the appropriate open/close configuration according to the monitored signals output from low and high quality entertainment systems 1–2. Controller 4 may, for example, consult a table stored in a conventional memory which indicates the appropriate switch settings for switches S1–S6 based upon the combination of signals monitored from low and high quality entertainment systems 1–2.

Figure 4:
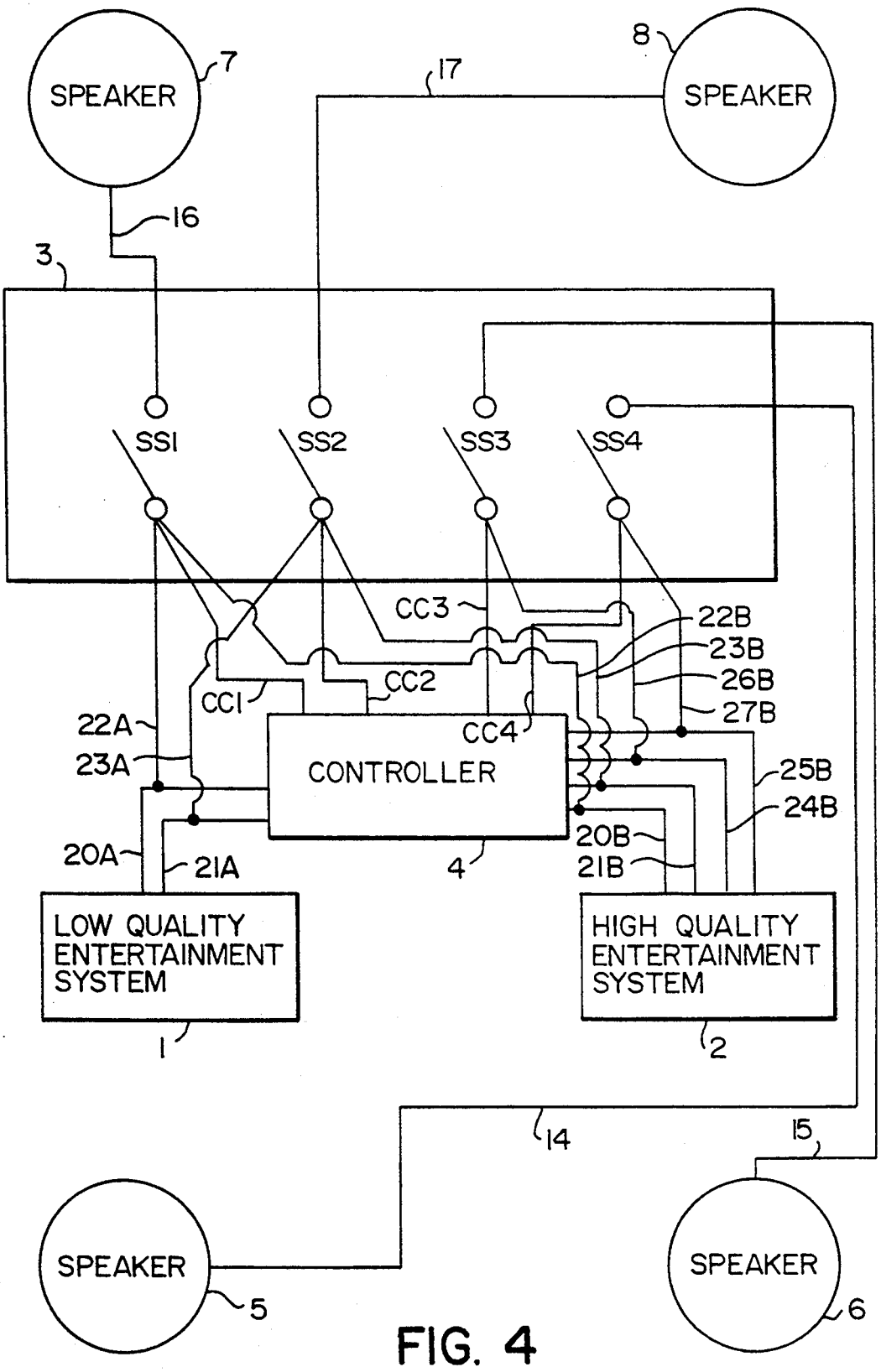
FIG. 4 is a detailed circuit diagram of a second embodiment of the entertainment system of the present invention.

FIG. 4 is a detailed circuit diagram of a second embodiment of the entertainment system of the present invention. In FIG. 4, instead of six separate switches S1–S6 as illustrated in FIG. 3, the second embodiment of the invention includes four switches SS1–SS4. As shown in FIG. 4, speakers 5–8 are connected to switches SS1-SS4 via conductors 14–17. In addition, controller 4 is also connected to switches SS1–SS4 via conductors CC1–CC4 for controlling the opening and closing of the switches responsive to the signals monitored from low and high quality entertainment systems 1–2. Accordingly, controller 4 is connected to low and high quality entertainment systems 1–2 via conductors 20A, 21A, 20B, 21B, 24B and 25B for monitoring the signals output from low and high quality entertainment systems 1–2. Further, low and high quality entertainment systems 1–2 are connected to switches SS1–SS4 via conductors 22A, 23A, 22B, 23B, 26B and 27B. As illustrated, since only four switches SS1–SS4 are used, low and high quality entertainment systems 1–2 share switches SS1 and SS2. The benefit in this embodiment that fewer switches are needed, i.e. only four switches SS1–SS4, and fewer conductors are also needed, i.e., only four conductors 14–17. Thus, the second embodiment minimizes the hardware needed to accomplish the specific results of the present invention.

Figure 5:
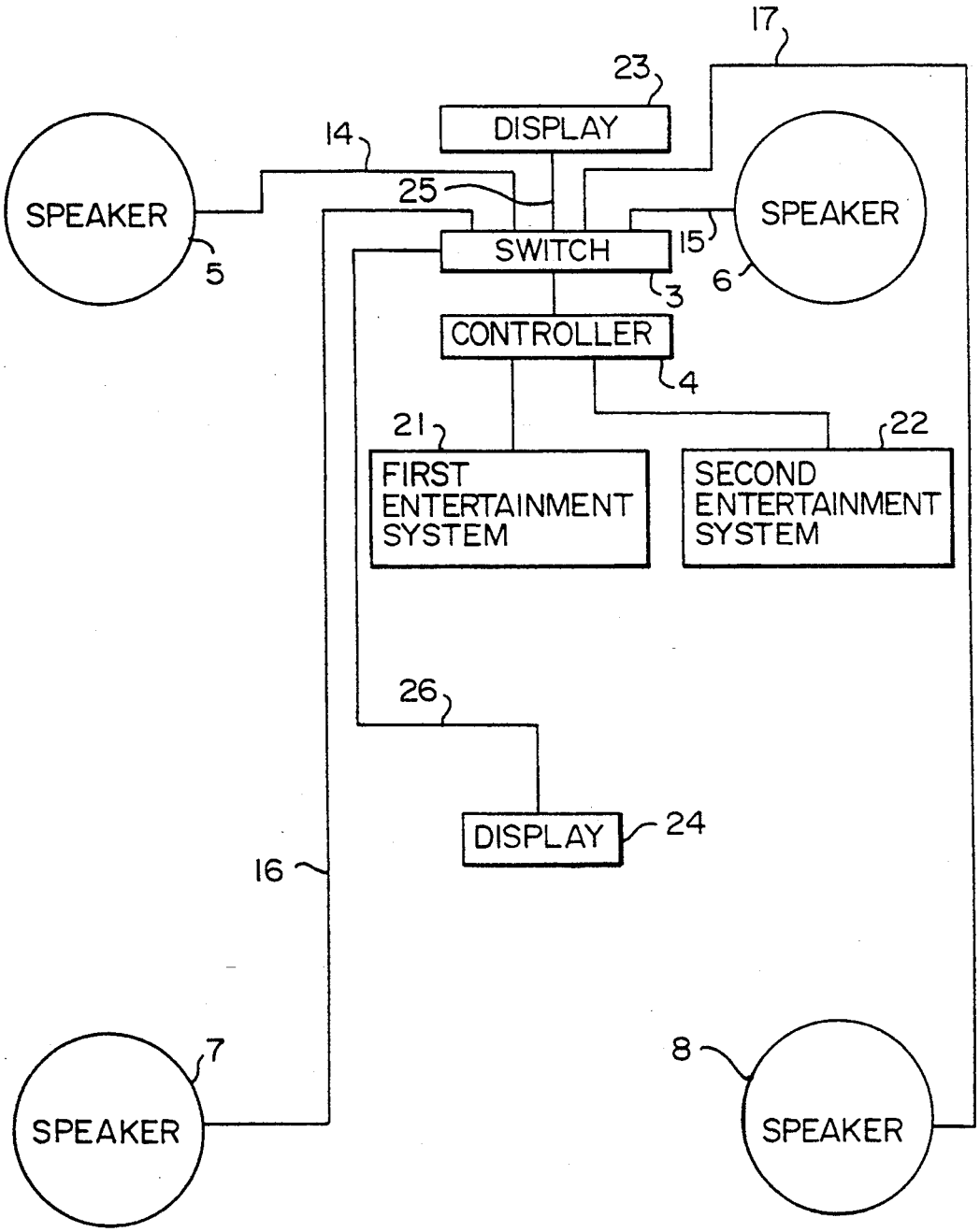
FIG. 5 is a conceptual drawing of the present invention also employing displays for viewing the entertainment.

FIG. 5 is a conceptual drawing of the present invention which may also employ displays for viewing the entertainment. In FIG. 5, four speakers 5–8 are typically provided in a vehicle; for example two speakers 5–6 for the passengers sitting in seats located in a first position of the vehicle, and two speakers 7–8 for passengers sitting in seats located in a second position of the vehicle. In the present invention, each of speakers 5–8 are connected to switch 3 via conductors 14–17. Switch 3 is also connected to first and second entertainment systems 21 and 22 to connect the appropriate entertainment system to the appropriate speakers as required. Further, displays 23 and 24 are also provided and connected to switch 3 via conductors 25 and 26 to permit entertainment broadcast from first and second entertainment systems 21 and 22 to be viewed by passengers sitting in seats located in the first and second locations of the vehicle.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

I claim:

1. An entertainment system for a vehicle having front and rear speakers, comprising:

a high quality entertainment system for playing a high quality medium to first passengers of the vehicle desiring high quality entertainment by outputting a high quality signal;

a low quality entertainment system for playing a low quality medium of a same type as the high quality medium to second passengers of the vehicle by outputting a low quality signal;

controller means for monitoring the high and low quality signals output from said high and low quality entertainment systems respectively, and for outputting a control signal to control switching between said high and low quality entertainment systems and the front and rear speakers responsive to the high and low quality signals;

a switch, connected to said low and high quality entertainment systems and said controller means, said switch connecting said low and high quality entertainment systems responsive to the control signal received from said controller means, wherein when said controller means detects only the low quality signal output from said low quality entertainment system, said controller means controls said switch to connect said low quality entertainment system to the rear speaker of the vehicle, wherein when said controller means detects only the high quality signal output from said high quality entertainment system, said controller means controls said switch to connect said high quality entertainment system to the front and rear speakers of the vehicle, and wherein when said controller means detects the low and high quality signals output from said low and high quality entertainment systems, said controller means controls said switch to connect said high quality entertainment system to the front speaker of the vehicle, and said controller means controls said switch to connect said low quality entertainment system to the rear speaker of the vehicle.

2. An entertainment system according to claim 1, wherein the front speaker comprises first and second front speakers, and the rear speaker comprises first and second rear speakers, wherein said switch comprises first, second, third, fourth, fifth and sixth switches, the first and third switches connected to the first front speaker, the second and fourth switches connected to the second front speaker, the fifth switch connected to the first rear speaker and the sixth switch connected to the second rear speaker.

3. An entertainment system according to claim 2, wherein the first and third switches are connected to the first front speaker via first and second conductors, the second and fourth switches connected to the second front speaker via third and fourth conductors, the fifth switch connected to the first rear speaker via a fifth conductor and the sixth switch connected to the second rear speaker via a sixth conductor.

4. An entertainment system according to claim 1, further comprising a memory for storing connection data connected to said controller means, and wherein said controller means outputs the control signal responsive to a comparison of the low and high quality signals with the connection data stored in said memory.

5. An entertainment system according to claim 1, further comprising front and rear video displays connectable to said low and high quality entertainment systems via said switch and said controller means, wherein the low and high quality signals comprise low and high quality audio and video signals, and wherein said low and high quality entertainment systems output the low and high quality audio signals to the front and rear speakers via said switch and said controller means, and said low and high quality entertainment systems output the low and high quality video signals to the front and rear video displays via said switch and said controller means.

6. An entertainment system according to claim 1, wherein the low quality medium and the high quality medium are one of a cassette tape, a video tape, a compact disc, a video disc and a digital tape.

7. An entertainment system according to claim 1, wherein the front speaker comprises first and second front speakers, and the rear speaker comprises first and second rear speakers, wherein said switch comprises first, second, third and fourth switches, the first switch connected to the first front speaker, the second switch connected to the second front speaker, the third switch connected to the first rear speaker and the fourth switch connected to the second rear speaker.

8. An entertainment system according to claim 7, wherein the first switch is connected to the first front speaker via a first conductor, the second switch is connected to the second front speaker via a second conductor, the third switch is connected to the first rear speaker via a third conductor and the fourth switch is connected to the second rear speaker via a fourth conductor.

9. An entertainment system according to claim 8, further comprising a memory storing connection data connected to said controller means, and wherein said controller means outputs the control signal responsive to a comparison of the low and high quality signals with the connection data stored in said memory.

10. An entertainment system according to claim 9, further comprising front and rear video displays connectable to said low and high quality entertainment systems via said switch and said controller means, wherein the low and high quality signals comprise low and high quality audio and video signals, and wherein said low and high quality entertainment systems output the low and high quality audio signals to the front and rear speakers via said switch and said controller means, and said low and high quality entertainment systems output the low and high quality video signals to the front and rear video displays via said switch and said controller means.

11. An entertainment system according to claim 10, wherein the low quality medium and the high quality medium are one of a cassette tape, a video tape, a compact disc, a video disc and a digital tape.

12. A method of providing entertainment using an entertainment system for a vehicle having front and rear speakers, comprising the steps of:

(a) playing a high quality medium to first passengers of the vehicle desiring high quality entertainment by outputting a high quality signal from a high quality entertainment system;

(b) playing a low quality medium of a same type as the high quality medium to second passengers of the vehicle by outputting a low quality signal from a low quality entertainment system;

(c) monitoring the high and low quality signals output from the high and low quality entertainment systems respectively, and outputting a control signal to control switching between the high and low quality entertainment systems and the front and rear speakers responsive to the high and low quality signals output from said playing steps (a) and (b);

(d) connecting the low and high quality entertainment systems responsive to the control signal output from said monitoring step (c), wherein when said monitoring step (c) detects only the low quality signal output from the low quality entertainment system, said monitoring step (c) controls said connecting step (d) to connect the low quality entertainment system to the rear speaker of the vehicle, wherein when said monitoring step (c) detects only the high quality signal output from the high quality entertainment system, said monitoring step (c) controls said connecting step (d) to connect the high quality entertainment system to the front and rear speakers of the vehicle, and wherein when said monitoring step (c) detects the low and high quality signals output from the low and high quality entertainment systems, said monitoring step (c) controls said connecting step (d) to connect the high quality entertainment system to the front speaker of the automobile, and said monitoring step (c) controls said connecting step (d) to connect the low quality entertainment system to the rear speaker of the vehicle.

13. An entertainment system for a vehicle having first and second broadcast devices, comprising;

a first entertainment system for playing a first medium for first entertainment by outputting a first signal to the first broadcast device located in a first location of the vehicle;

a second entertainment system for playing a second medium by outputting a second signal to the second broadcast device located in a second location of the vehicle;

controller means for monitoring the first an second signals output from said first and second entertainment systems respectively, and for outputting a control signal to control switching between said first and second entertainment systems and the first and second broadcast devices responsive to the first and second signal;

a switch, connected to said first and second entertainment systems and to said controller means, said switch connecting said first and second entertainment systems responsive to the control signal received from said controller means, wherein when said controller means detects the first and second signals output from said first and second entertainment systems, said controller means controls said switch to connect said first entertainment system to the first broadcast device in the vehicle, and said switch connects said second entertainment system to the second broadcast device in the vehicle for simultaneously broadcasting the first and second entertainment media.

14. An entertainment system according to claim 13, wherein when both said first and second entertainment systems are used, the first and second media broadcast in the first and second locations of the vehicle do not substantially interfere with each other.

15. An entertainment system according to claim 14, wherein a first passenger is able to substantially experience the first medium without substantial interference from the second medium, and wherein a second passenger is able to substantially experience the second medium without substantial interference from the first medium.

16. An entertainment system according to claim 13, wherein each of the first medium and the second medium are one of a cassette tape, a video tape, a compact disc, a video disc and a digital tape.

17. A method of providing entertainment using an entertainment system for a vehicle having first and second broadcast devices, comprising the steps of:

(a) playing a first medium to first passengers of the vehicle by outputting a first signal from a first entertainment system;

(b) playing a second medium to second passengers of the vehicle by outputting a second signal from a second entertainment system;

(c) monitoring the first and second signals output from the first and second entertainment systems respectively, and outputting a control signal to control switching between the first and second entertainment systems and the first and second broadcast devices responsive to the first and second signals output from said playing steps (a) and (b);

(d) connecting the first and second entertainment systems responsive to the control signal output from said monitoring step (c), wherein when said monitoring step (c) detects only the first signal output from the first entertainment system, said monitoring step (c) controls said connecting step (d) to connect the first entertainment system to the first broadcast device of the vehicle, wherein when said monitoring step (c) detects only the second signal output from the second entertainment system, said monitoring step (c) controls said connecting step (d) to connect the second entertainment system to the second broadcast device of the vehicle.

18. A method according to claim 17, wherein instead of said connecting step (d), said method comprises the step of connecting the first entertainment system to the first broadcast device of the vehicle and the second entertainment system to the second broadcast device of the vehicle when said monitoring step (c) detects both the first and second signals output from the first and second entertainment systems.

19. A method according to claim 17, wherein the first medium and the second medium are each one of a cassette tape, a video tape, a compact disc, a video disc and a digital tape.

20. A method according to claim 17, wherein instead of said connecting step (d), said method comprises the step of connecting the second entertainment system to one of the second broadcast device, and the first and second broadcast devices when said monitoring step (c) detects only the second signal output from the second entertainment system.

* * * * *